US011232770B1

(12) United States Patent
Katzenberger

(10) Patent No.: US 11,232,770 B1
(45) Date of Patent: Jan. 25, 2022

(54) FLOATING SOUNDBOARD ACOUSTIC GUITAR

(71) Applicant: Joseph J. Katzenberger, Crawfordsville, IN (US)

(72) Inventor: Joseph J. Katzenberger, Crawfordsville, IN (US)

(73) Assignees: Joseph J. Katzenberger, Crawfordsville, IN (US); Mark Katzenberger, Arlington, VA (US)

( * ) Notice: Subject to any disclaimer, the term of this patent is extended or adjusted under 35 U.S.C. 154(b) by 0 days.

(21) Appl. No.: 17/002,428

(22) Filed: Aug. 25, 2020

(51) Int. Cl.
*G10D 1/08* (2006.01)
*G10D 3/06* (2020.01)
*G10D 3/04* (2020.01)

(52) U.S. Cl.
CPC ..... *G10D 1/08* (2013.01); *G10D 3/04* (2013.01); *G10D 3/06* (2013.01)

(58) Field of Classification Search
CPC ..... G10D 1/08; G10D 3/04; G10D 3/06
See application file for complete search history.

(56) References Cited

U.S. PATENT DOCUMENTS 3,656,395 A 4/1972 Kaman
3,892,159 A 7/1975 Houtsma
4,987,815 A 1/1991 Shockley
5,208,410 A 5/1993 Foley
5,333,527 A 8/1994 Janes
5,461,958 A 1/1995 Dresdner
5,549,027 A 8/1996 Steinberger
5,567,896 A 10/1996 Gottschall
5,661,252 A 8/1997 Krawczak
5,682,003 A 10/1997 Jarowsky
6,040,510 A 3/2000 Yaun
6,646,191 B1 11/2003 Martin
6,833,501 B2 12/2004 Jagmin
7,019,202 B1 3/2006 Hetzel
7,446,247 B2 11/2008 Shellham
9,502,006 B1 11/2016 Takiguchi
2007/0234872 A1* 10/2007 Cody ..... G10D 3/02 84/291

OTHER PUBLICATIONS

U.S. Appl. No. 10,686,839, filed Oct. 14, 2003, Henry Langeman/U.S.
U.S. Appl. No. 11,810,948, filed Jun. 7, 2007, Jan Anders Linden/U.
U.S. Appl. No. 11,728,806, filed Oct. 11, 2007, William F. Cody.

* cited by examiner

*Primary Examiner* — Jianchun Qin

(57) ABSTRACT

This invention is an acoustic guitar with a floating soundboard. The soundboard is attached to the body with shoulder bolts, rubber grommets, washers, and nuts (no adhesive). This allows the soundboard to float, due to the rubber grommets that will provide a great amount of movement. This results in dramatically greater volume, and improved tone (due to less force required on the guitar strings). The material for the body is Rock Maple, and the other materials are Sitka Spruce, Rosewood and Mahogany.

2 Claims, 3 Drawing Sheets

FLOATING SOUNDBOARD ACOUSTIC GUITAR

BACKGROUND OF INVENTION

This solves the problem of an acoustic guitar not having enough volume (or related beautiful tone due to this), in an acoustic environment, especially with other instruments. Classical guitars are not, and generally never have been included as a standard instrument in a symphony orchestra, due to lack of volume. Listen to an acoustic guitar being played with a violin, a piano, a banjo, and/or any brass instrument. The acoustic guitar can't be heard well, in an acoustic environment with other acoustic instruments. You can hear it within ten feet of the music. At twenty feet, thirty feet, and more, these other acoustic instruments can all be heard easily, but the acoustic guitar sound is greatly reduced. Other products include an acoustic/electric guitar that can be plugged into an amplifier. This type of guitar uses a pickup under the strings, does not capture the true acoustic sound of the guitar, and does not enhance the sound in any way (folded horn or other). Acoustic/electric guitars are not meant to be played through guitar amplifiers, which are made for electric guitars (some amps are made for acoustic guitars, which are much better). The closest alternative is using an acoustic guitar with a high end microphone into a public address system (more on this later). My product is made to produce an acoustic, pure, beautiful sound, with greater volume.

The floating soundboard will have much more vibration (the source of all sound), and movement than a traditional acoustic guitar soundboard. This is because a traditional acoustic guitar soundboard is glued to the body. This floating soundboard is not glued to the acoustic guitar body in any way. It is attached to the body with a shoulder bolt, two rubber grommets, two washers, and two nuts, which allows the soundboard to float, due to the rubber grommets that will provide a great amount of movement. This shoulder bolt, rubber grommet, washer, and nut assembly is placed in twenty nine locations around the perimeter of the soundboard.

The guitar body has access holes to the shoulder bolt nuts from the back side, so the shoulder bolt assembly and soundboard can be adjusted or removed very easily.

The guitar body is manufactured from high quality Rock Maple available online (two 3"×18"×24" pieces laminated together). This will allow machining of the back and sides from one solid piece of material to form the guitar body, which we need for the unusual body shape, and also to minimize cost without affecting quality. The only way this can be manufactured is with computer numerical control programming and machining. A Luthier with standard guitar building tools can't build this guitar completely. That said, a Luthier is required to fit, hand work and assemble this guitar, to assure the highest levels of quality. This is a true combination of technology and craftsmanship. The goal is to build an acoustic guitar with increased volume, so the guitar player can easily play/vibrate the strings, resulting in a beautiful rich tone, not degraded by excessive force on the strings. It should be noted that all sound normally generated from the body of the guitar remains, and is actually enhanced due to the larger soundboard. This is all possible while being UNPLUGGED.

Other innovations include a thin and light (yet strong) soundboard. This projects more sound, due to increased soundboard vibration. This is achieved by cutting the soundboard from a solid piece of wood, and not gluing braces by the traditional method.

To maintain strength and provide musical sustain, the neck is dovetailed, screwed and doweled to the body. This is possible due to the solid back and sides. The finger board is cut short on the soundboard (by five frets), to allow more soundboard vibration. These frets are rarely used on an acoustic guitar, so this is an improvement. The traditional truss rod to adjust the neck is included in this design.

The Bridge is also longer, and provides more vibration to the soundboard. This is possible, because the underside of the bride is relieved (cut away). This allows more contact over a greater length with the soundboard, but does not increase the actual square inch contact area by a great amount.

String height (action), is completely different and improved. Almost all acoustic guitars have a fixed nut and fixed saddle. While the saddle can be adjusted with shims, this is not effective to adjust action. String height is very important, as it affects tone, string noise (buzz), and the ability to play with less effort. It also affects the ability to play slide guitar, which is a great technique on the acoustic guitar. The nut is recessed into a pocket, which allows it to be free standing, and adjustable. This is achieved by suppling ten different nut components, all of different height. There are also ten different saddle components, all of different height. The combination of these different nut and saddle heights allows string action adjustment never seen before.

Finally, as mentioned earlier, this guitar has been completely prototyped as a virtual design (complete digital 3D computer aided design, available for view upon request). After the utility patent has been granted, this design will be available on the internet, to receive input from many people. This can help determine who may be interested in building this guitar, who may provide improvements, and who might develop improved ideas for their own designs and patents. The goal is to license this idea to people that understand guitar building, (but they must have the computer numerical equipment to handle this project). It should be noted that I am a music lover, and hope to spread this idea to others, after first protecting myself legally.

SUMMARY OF INVENTION

As described above, this invention is an acoustic guitar that produces higher volume and improved tone, while being played with much less effort (less distortion). The floating soundboard provides this greater volume, without degrading tone, due to a much larger increase of soundboard vibration and movement.

DRAWINGS OF INVENTION

All manufactured components of this instrument are completely detailed in drawings, and are available for review. This product is modeled in a 3D CAD system for design and computer controlled manufacturing. 100% of all components are included, right down to mother of pearl inlay. All components can be programmed from this solid model for manufacturing. This project considers design for manufacturing (DFM) methods, to eliminate redesign for manufacturing. That said, this guitar has been redesigned many times, due to research and developments efforts.

DETAILED DESCRIPTION

Figure 1:
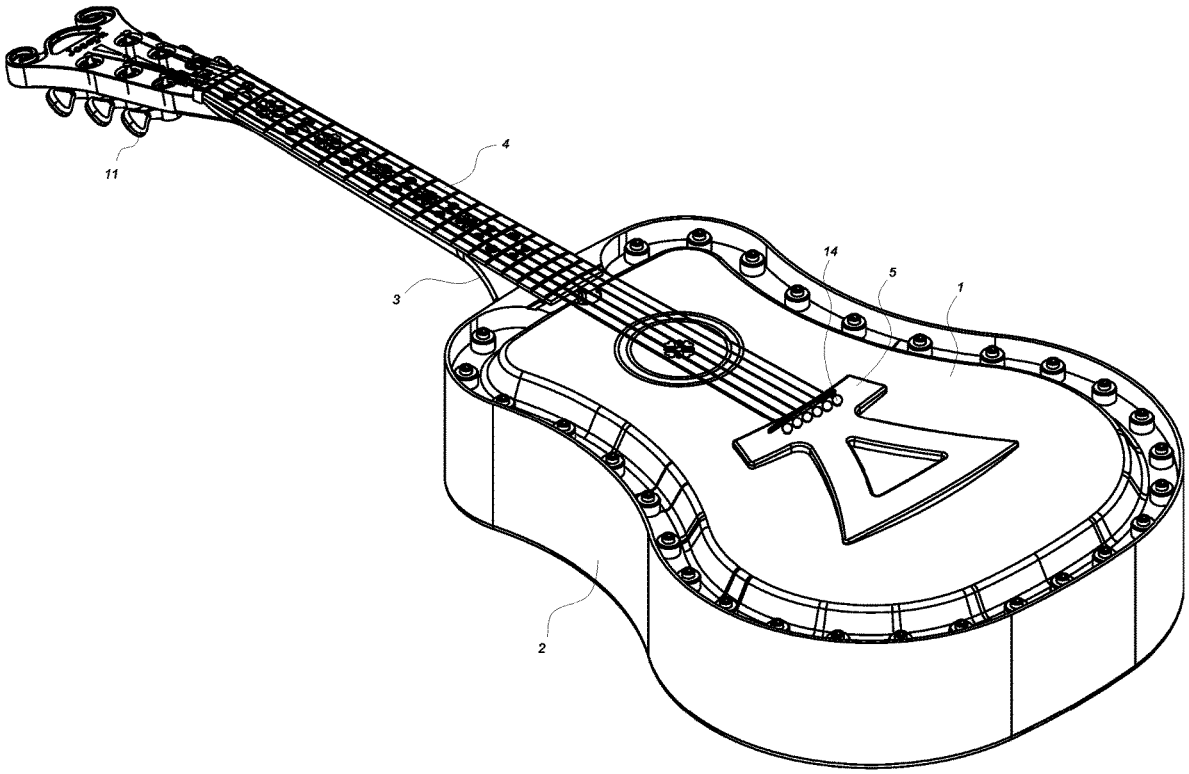
FIG. 1—Complete assembly (sheet 1).

Referring now to the drawings: FIG. 1 illustrates an acoustic guitar with a back, and a side, all machined from a solid piece of wood to form a guitar body 2, (two 3"×18"×24" laminated maple blocks joined by bonded adhesive, (Michigan Maple Block Petoskey, Mich.). This is manufactured using the well-known computer numerical controlled machining process. All components have been reviewed for DFM (design for manufacturing), so the machining process does not have any unknown complications. The neck 3, is shown connected to the guitar body 2, and also connected to the fingerboard 4. These and all other components, are shown in greater detail in additional FIGURES for clarity. Note that six strings are shown, which should be light gage, to avoid excessive force on soundboard. These are standard strings that can be purchased at any music store, and are installed the same as any other acoustic guitar. The bridge 5, is also shown. This is a large bridge, attached to the light yet strong soundboard 1, to assist in greater vibration of light yet strong soundboard 1. If this is proved to be detrimental, the bridge is "wood safe" meaning large enough to reduce easily if required. Also shown are six string pins 14 (known standard component) that attaches the strings to the bridge 5. Also shown are six tuning heads 11, which are attached to the neck 3. Drill size, tap size and location will be added to suit, based on actual component brand (known standard component).

Figure 2:
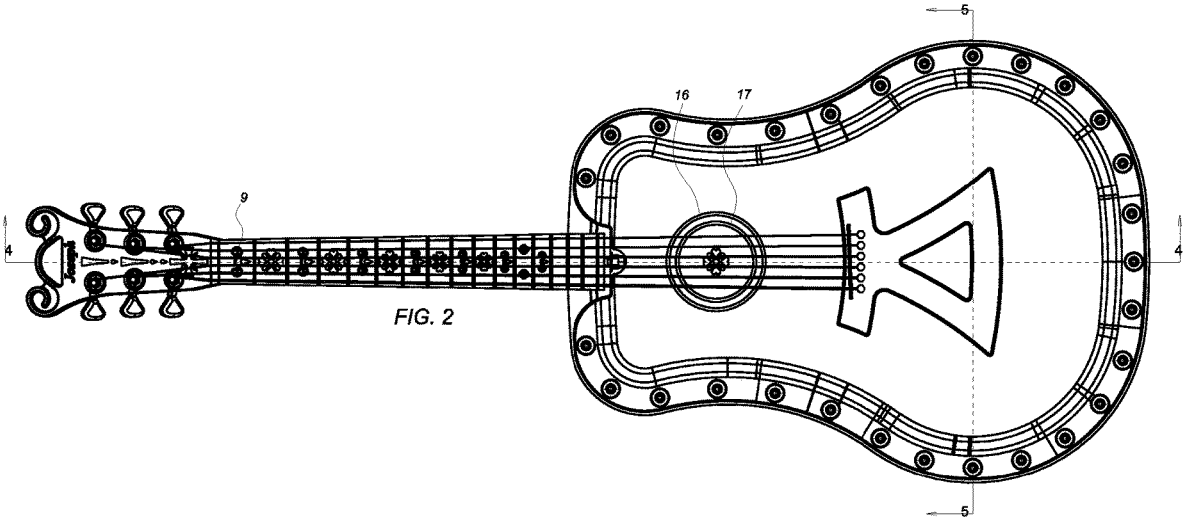
FIG. 2—Top view (sheet 2).

FIG. 2 shows the top view assembly of the guitar, which section 4-4 and section 5-5 are taken from. It also shows 16 rosette outer, and 17 rosette inner. These are blind pockets, and are only decorative. Also shown are ninety six pieces of mother of pearl inlay 9, included in fingerboard 4.

Figure 3:
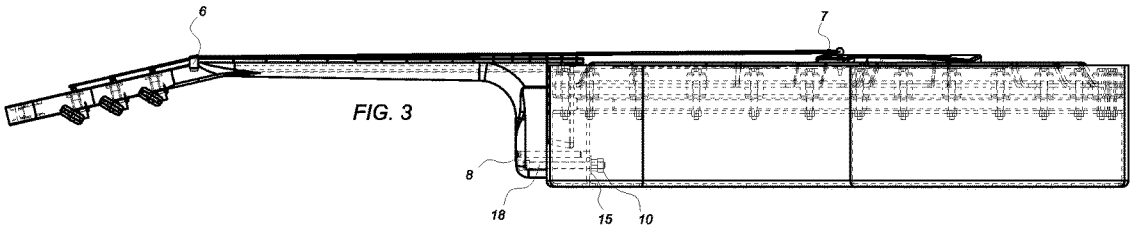
FIG. 3—Front view from FIG. 2 (sheet 2).

FIG. 3 which is a front view from FIG. 2, shows the adjustable saddle 7, pocketed into the bridge 5, and the adjustable nut 6, pocketed into the neck 3, so they do not need to be held in place by adhesive (see FIG. 1). This allows the action of the strings to be set from both ends of the guitar, which offers far more action settings. The nut 6 and saddle 7 can be adjusted with multiple sizes of nuts 6, and saddles 7 provided (ten each). Also shown are two steel dowels 8, socket head cap screw 18, steel washer 15, and lock nut 10.

Figure 4:
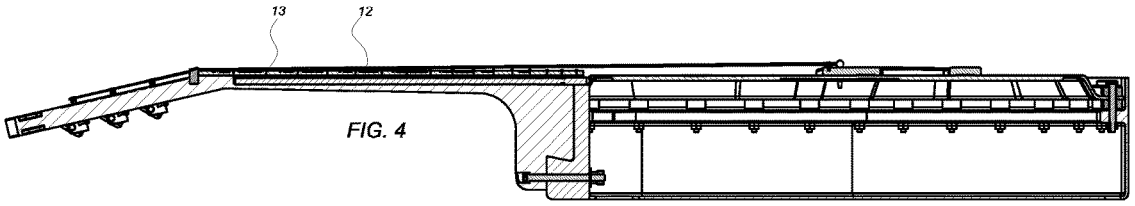
FIG. 4—Section 4—4 from FIG. 2 (sheet 2).

FIG. 4 (section 4-4 from sheet 2, FIG. 2) shows truss rod 12 (14½" truss rod marketed by Bitterroot Guitars of Door, Mich.), and seventeen frets 13. These are standard components in any acoustic guitar. The truss rod 12, is set inside of neck 3, and allows for adjustment of neck 3, to keep it straight. The frets allow for precise fingering, and correct pitch of the strings.

Figure 5:
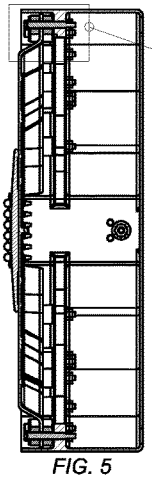
FIG. 5—Section 5—5 from FIG. 2 (sheet 2).
Figure 6:
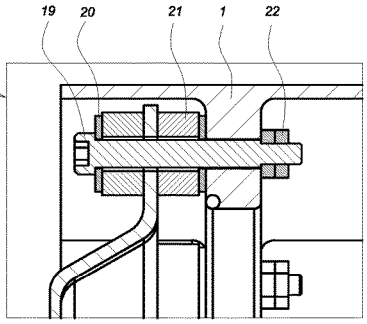
FIG. 6—Floating assembly components (29) places (sheet 2)

FIG. 5 (section 5-5 from sheet 2, FIG. 2) shows overall width of guitar, and also provides direction for FIG. 6 4× scale view.

FIG. 6, a 4× scale view from FIG. 5, shows shoulder bolt 19, steel washer 20, rubber grommet 21, nut 22, and light yet strong soundboard 1, together in assembly.

Figure 7:
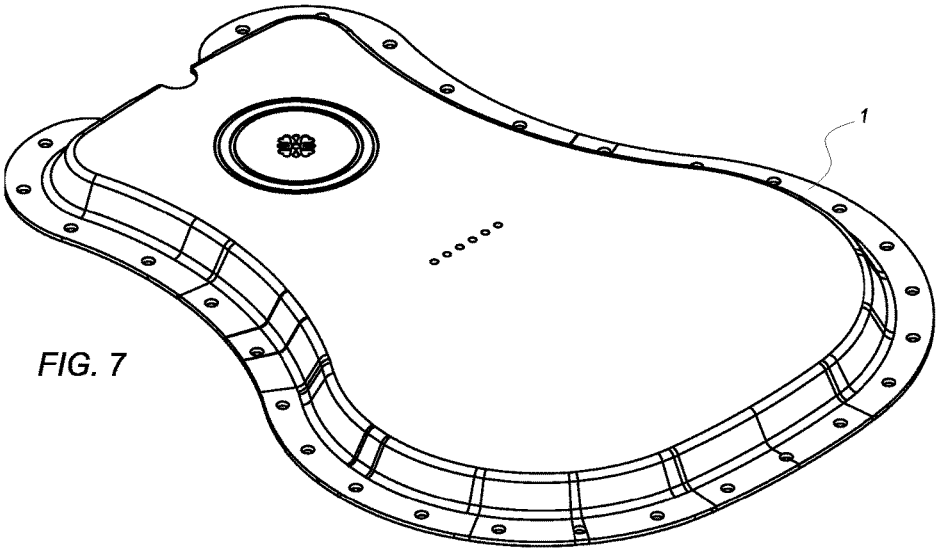
FIG. 7—Light yet strong soundboard top perspective view.

FIG. 7, shows soundboard 1, in a top perspective view.

Figure 8:
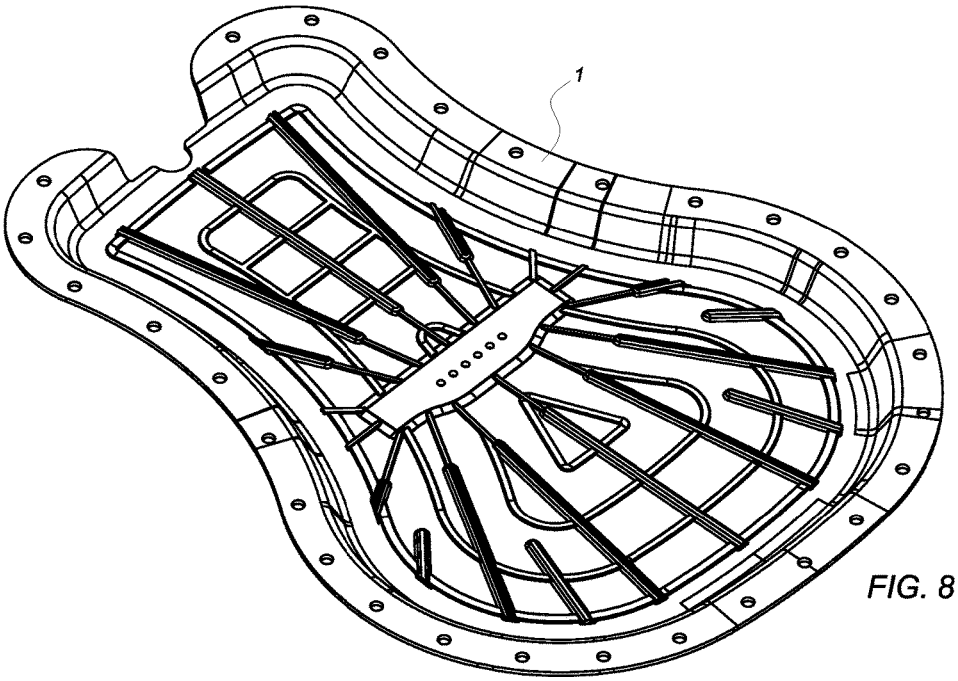
FIG. 8—Light yet strong soundboard bottom perspective view, which is flipped 180 degrees from FIG. 7 (sheet 2).

FIG. 8 shows soundboard 1, in a bottom perspective view, which is flipped 180 degrees from FIG. 7 (sheet 2).

I claim:

1. An acoustic guitar, comprising:

a back, a side, an internal ledge that is machined perpendicular to said side and parallel to said back, with large radii for strength on top and bottom of said internal ledge, blending into said side, preventing deflection of said ledge, providing a strong surface for mounting components that are required for accurate and repeatable function of said acoustic guitar, wherein said back, said side, and said internal ledge are all machined from a solid piece of wood to form a guitar body, with access holes in back of said guitar body for ease of assembly; an elongated neck attached to said guitar body;

a floating soundboard attached to said guitar body and said internal ledge;

a specified amount of stripper bolts attached to said guitar body and said internal ledge;

a specified amount of nuts attached to said stripper bolts and said internal ledge;

a specified amount of rubber grommets attached to said floating soundboard and said internal ledge;

a specified amount of washers attached to said rubber grommets and said internal ledge;

a bridge attached to said floating soundboard;

an adjustable nut attached to said elongated neck;

an adjustable saddle attached to said bridge; and a guitar string set attached to said bridge, said adjustable saddle, said adjustable nut and said elongated neck.

2. The acoustic guitar of claim 1, wherein said floating soundboard is attached to said guitar body and said internal ledge, with twenty-nine equally spaced said stripper bolts, which are parallel to said side, fifty-eight equally spaced said nuts, which are parallel to said back and said internal ledge, fifty-eight equally spaced said washers, which are parallel to said back and said internal ledge, and are directly above and below said rubber grommets, fifty-eight equally spaced said rubber grommets, which are parallel to said back and said internal ledge, and are directly above and below said floating soundboard, providing: balanced movement of said floating soundboard perpendicular to said side, and parallel to said back and said internal ledge, which allows more movement of said floating soundboard compared to standard soundboards that only vibrate and do not move perpendicular to said guitar body, causing said floating soundboard to move like a speaker, which provides a much greater amount of volume, which will be much louder than said standard soundboard, which will also provide much more sustain than said standard soundboard, which allows said floating soundboard adjustment by changing thickness of said rubber grommets, which can be adjusted based on force applied to said floating soundboard and said internal ledge from tension of said guitar string set, which will reduce distortion of said floating soundboard, and also allows complete disassembly and adjustment of said floating soundboard due to twenty-nine said access holes in back of said guitar body, which is possible due to said guitar body and said internal ledge being machined from the same said solid piece of wood, and also due to said internal ledge design increasing strength of, and reducing distortion on, said guitar body, comprising: said floating soundboard machined from said solid piece of wood, allowing said floating soundboard to be configured with small but strong ribs, which provides light weight and increased strength, resulting in increased vibration and movement of said floating soundboard and a greater amount of air displacement, which greatly increases volume of said acoustic guitar.

* * * * *